US007290309B2

(12) United States Patent
Rocke

(10) Patent No.: US 7,290,309 B2
(45) Date of Patent: Nov. 6, 2007

(54) CLEANING HEAD FOR A VACUUM CLEANER WITH EDGE CLEANING BRISTLES

(75) Inventor: Alexander Simon David Rocke, Malmesbury (GB)

(73) Assignee: Dyson Limited, Wiltshire (GB)

( * ) Notice: Subject to any disclaimer, the term of this patent is extended or adjusted under 35 U.S.C. 154(b) by 338 days.

(21) Appl. No.: 10/468,653

(22) PCT Filed: Feb. 12, 2002

(86) PCT No.: PCT/GB02/00613

§ 371 (c)(1),
(2), (4) Date: Aug. 21, 2003

(87) PCT Pub. No.: WO02/067749

PCT Pub. Date: Sep. 6, 2002

(65) Prior Publication Data

US 2004/0068829 A1 Apr. 15, 2004

(30) Foreign Application Priority Data

Feb. 24, 2001 (GB) ..... 0104674.7

(51) Int. Cl.
*A47L 9/06* (2006.01)

(52) U.S. Cl. ..... 15/364; 15/398

(58) Field of Classification Search ..... 15/364, 15/398, 400, 393, 416

See application file for complete search history.

(56) References Cited

U.S. PATENT DOCUMENTS

| | | | | |
|---|---|---|---|---|
| 1,844,915 | A * | 2/1932 | Nielsen | 15/398 |
| 3,942,219 | A * | 3/1976 | Johnson | 15/383 |
| 4,219,902 | A | 9/1980 | DeMaagd | |
| 4,685,170 | A | 8/1987 | Ahlf et al. | |
| 5,475,893 | A | 12/1995 | Sepke | |
| 6,094,776 | A * | 8/2000 | Fish | 15/398 |

FOREIGN PATENT DOCUMENTS

| | | | |
|---|---|---|---|
| CN | 85201147 | U | 1/1986 |
| CN | 2178094 | Y | 9/1994 |
| CN | 1053095 | C | 6/2000 |
| EP | 0 042 723 | B1 | 8/1985 |
| JP | 54-106056 | | 8/1979 |
| JP | 03-095850 | | 9/1991 |
| JP | 8-196486 | A | 8/1996 |
| WO | WO 99/52411 | A1 | 10/1999 |

OTHER PUBLICATIONS

Dyson.com WWW pages regarding DC04 model, web page address: www.dyson.com/models/DC04_ZRB.asp (WEB page created Feb. 5, 2001).

Vacuum Cleaner Forum WWW poages, last 3 messages regarding DC04 model, pp. 56-57, web page address: www.designmaker.com/vacuums/collector/f-0800.htm (Aug. 2000).

Japanese Office Action mailed Aug. 30, 2005, directed to JP Application No. 2002-567126.

* cited by examiner

*Primary Examiner*—Theresa T. Snider
(74) *Attorney, Agent, or Firm*—Morrison & Foerster LLP

(57) ABSTRACT

A cleaning head (30) for a vacuum cleaner comprises a housing (305) which extends transversely to the direction of intended movement (A) of the head. A row of bristles (310) extend outwardly from the sides of the housing (305). The bristles (310) extend transversely outwardly and forwardly from the housing and extend to a level beneath the lowermost surface of the housing. Dirt, dust and other debris which collects at the very edge of a room is either 'guided' out of the region next to the wall or is subjected to a vigorous 'flicking' action as the head (30) is moved across the floor. A suction channel (330) is located adjacent to the bristles. The bristles (310) are provided as a unit which is removable from the head (30).

10 Claims, 5 Drawing Sheets

CLEANING HEAD FOR A VACUUM CLEANER WITH EDGE CLEANING BRISTLES

FIELD OF THE INVENTION

This invention relates to a cleaning head for a vacuum cleaner and to a vacuum cleaner including such a cleaning head.

BACKGROUND OF THE INVENTION

Upright vacuum cleaners, such as the one shown in FIG. 1, are well known and include a cleaning head having a motor or air driven brush bar for agitating a floor covering. Such vacuum cleaners are efficient at cleaning those parts of a room which are spaced from the very edge of a room. The vacuum cleaner is pushed backwards a and forwards across a surface so as to agitate the surface. A motor-driven fan in the cleaner 'sucks' the dislodged dirt and dust from the region beneath the cleaning head and conveys it to a separating and collecting unit on the cleaner. It is known that dirt, dust and other debris can collect at the very edge of a floor surface, alongside the wall of the room. Upright vacuum cleaners can be used in an alternative mode of operation where, instead of pushing the cleaner across a surface and allowing the brush bar to agitate the surface, a user manually directs a hose to those parts of a room which cannot be reached by the cleaning head. However, it is time consuming to use the cleaner in this way and it is preferable to clean as much dirt as possible from the room using the cleaning head. Dyson Limited manufactures a vacuum cleaner with the name DC04™ which includes a single tuft of bristles on each side of the cleaning head. U.S. Pat. No. 4,219,902 shows a vacuum cleaning head with bristles which project outwardly from the cleaning head in a direction which is perpendicular to the side of the cleaning head and towards the floor surface. U.S. Pat. No. 4,685,170 shows a floor tool for a vacuum cleaner which has a tuft of bristles on each side which are both longer and less stiff than the other bristles such that they flex outwardly when the floor tool is in use on a floor surface.

SUMMARY OF THE INVENTION

The present invention seeks to provide a cleaning head for a vacuum cleaner which has an improved cleaning performance when used at the edges of a room.

Accordingly, a first aspect of the present invention provides a cleaning head for a vacuum cleaner comprising a housing which extends transversely to the direction of intended movement of the head and a continuous row of bristles, the bristles extending transversely outwardly and forwardly from at least one of the sides of the housing and extending to a level beneath the lowermost surface of the housing.

A cleaning head of this kind has the advantage that dirt, dust and other debris which collects at the very edge of a room is either 'guided' out of the region next to the wall or is subjected to a vigorous 'flicking' action as the head is moved across the floor.

The cleaning performance of the head is further improved by providing a suction channel adjacent to the bristles, the suction channel extending between the outer edge of the housing to a suction space within the housing. Thus, any dirt, dust and debris which is guided or 'flicked' out from the region adjacent the wall is more likely to be carried towards the collector on the vacuum cleaner by the fast flowing stream of air adjacent the row of bristles.

Preferably the bristles are removably held in the housing. This has the advantage that they can be easily replaced when they become worn or damaged.

A further aspect of the invention provides a vacuum cleaner incorporating a cleaning head of the kind described above.

BRIEF DESCRIPTION OF THE DRAWINGS

Embodiments of the invention will now be described, by way of example only, with reference to the accompanying drawings in which.

DETAILED DESCRIPTION OF THE DRAWINGS

Figure 1:
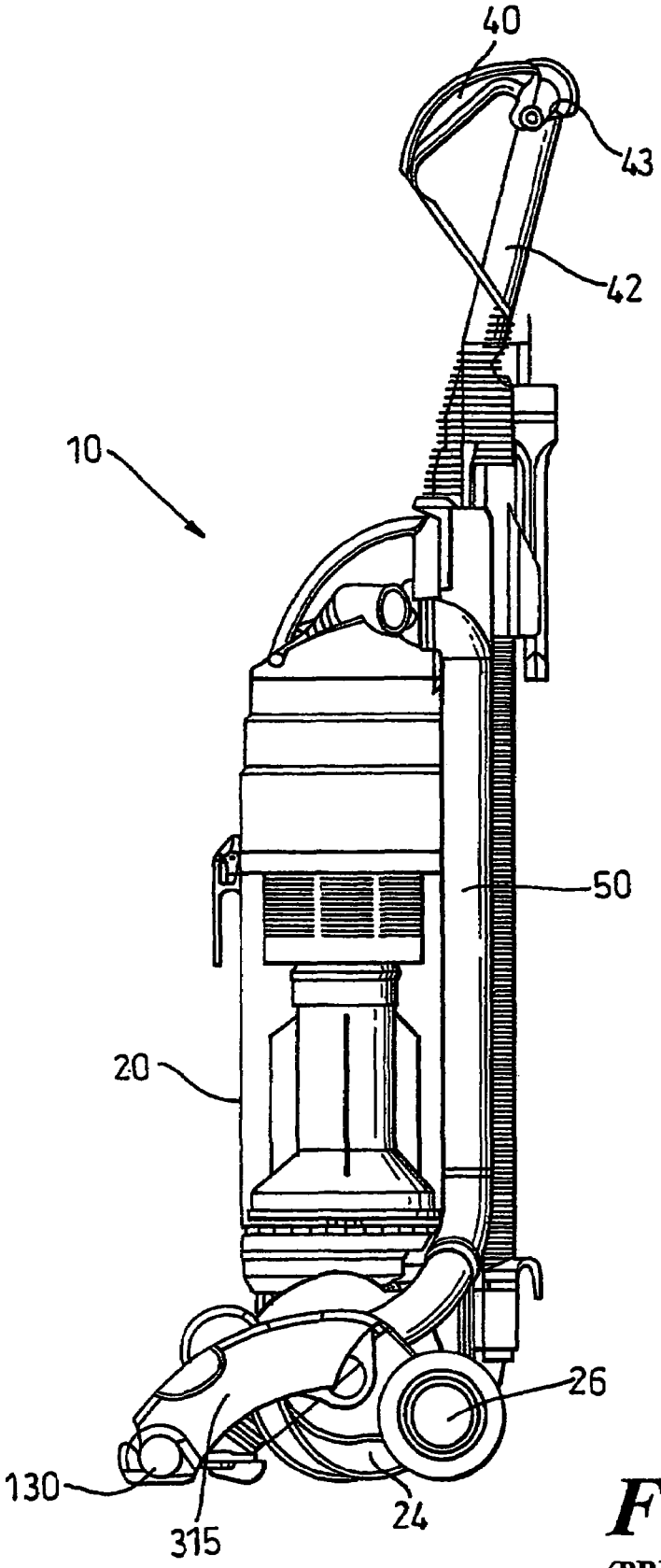
Fig. 1 (PRIOR ART)
FIG. 1 shows a known type of upright vacuum cleaner.

FIG. 1 shows a vacuum cleaner 10 having a main chassis 50 which supports dirt and dust separation apparatus 20. The lower part of the cleaner 10 comprises a cleaning head 130 for engaging with the floor surface. The cleaning head has a downwardly facing suction inlet and a brush bar is mounted in the mouth of the inlet for agitating the floor surface. The cleaning head is pivotably mounted to a motor housing 24 which houses the motor and fan of the cleaner. Support wheels 26 are mounted to the motor housing for supporting the cleaner and allowing movement across a floor surface. A spine of the chassis 50 extends upwardly from the motor housing 24 to provide support for the components of the cleaner. A cleaning wand 42 having a second dirty air inlet 43 is connected by way of a hose (not shown) to the chassis at the base of the spine 50. The wand 42 is releasable from the spine 50 so as to allow a user to carry out above-the-floor cleaning and cleaning in places which are inaccessible by the main cleaning head 130. When the wand is fixed to the spine 50, the wand 42 forms the handle of the cleaner and a handgrip 40 at the remote end of the wand 42 allows a user to manoeuvre the cleaner. These features of the cleaner are well known and have been well documented, for example, in other cleaners which are manufactured by Dyson Limited, and will not be described in any further detail.

Dirty air from the cleaning head 130 or wand inlet 43 is carried to the separator unit 20 by an inlet conduit (not shown). Separator 20 can be a cyclonic separator which spins dirt, dust and other debris out of the airflow by centrifugal separation as described more fully in EP 0 042 723, or the separator can be a conventional filter bag.

Figure 2:
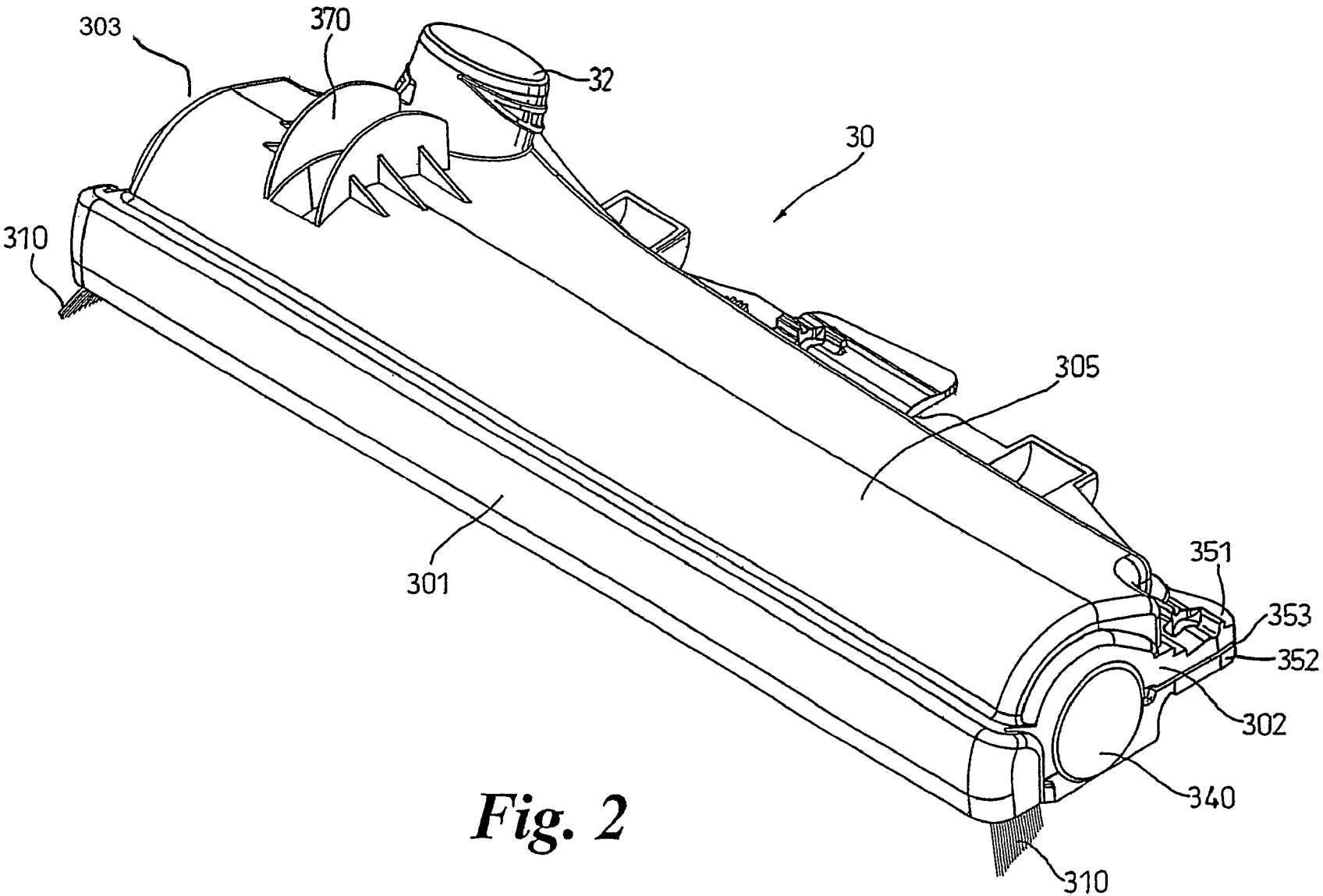
FIGS. 2-5 show an improved cleaning head for the cleaner of FIG. 1; and, FIG. 6 shows the cleaning head of FIGS. 2-5 in use on a floor surface.
Figure 3:
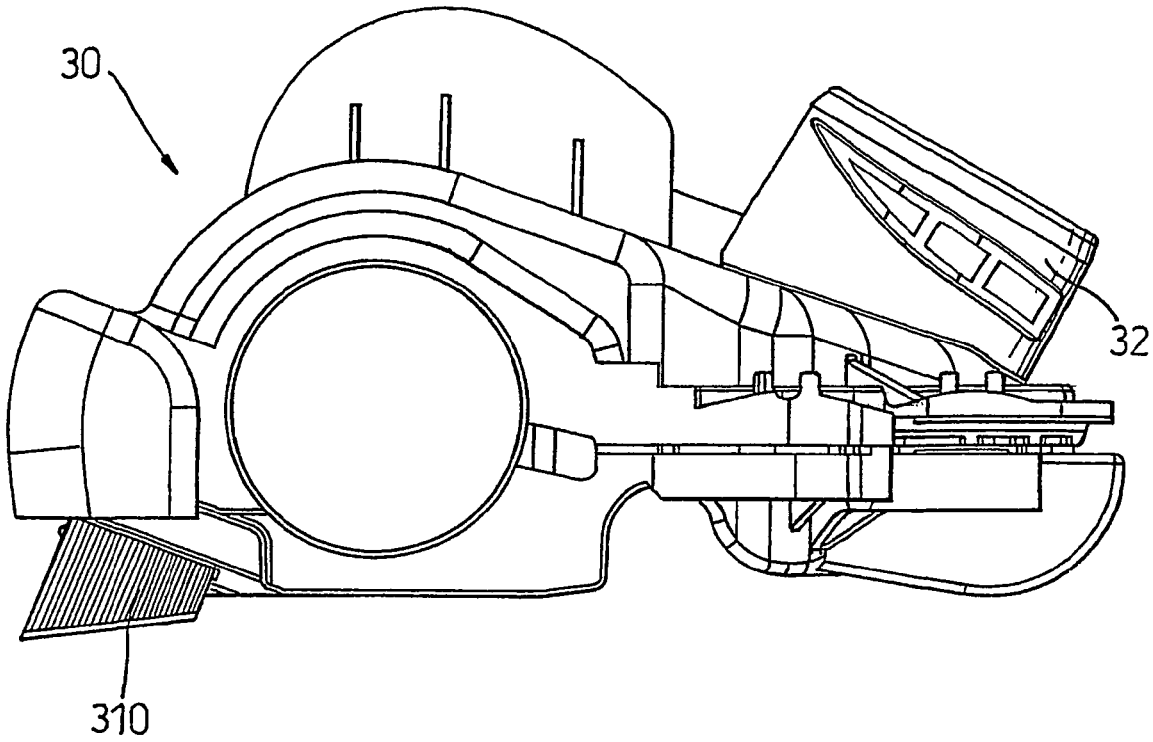
Figure 4:
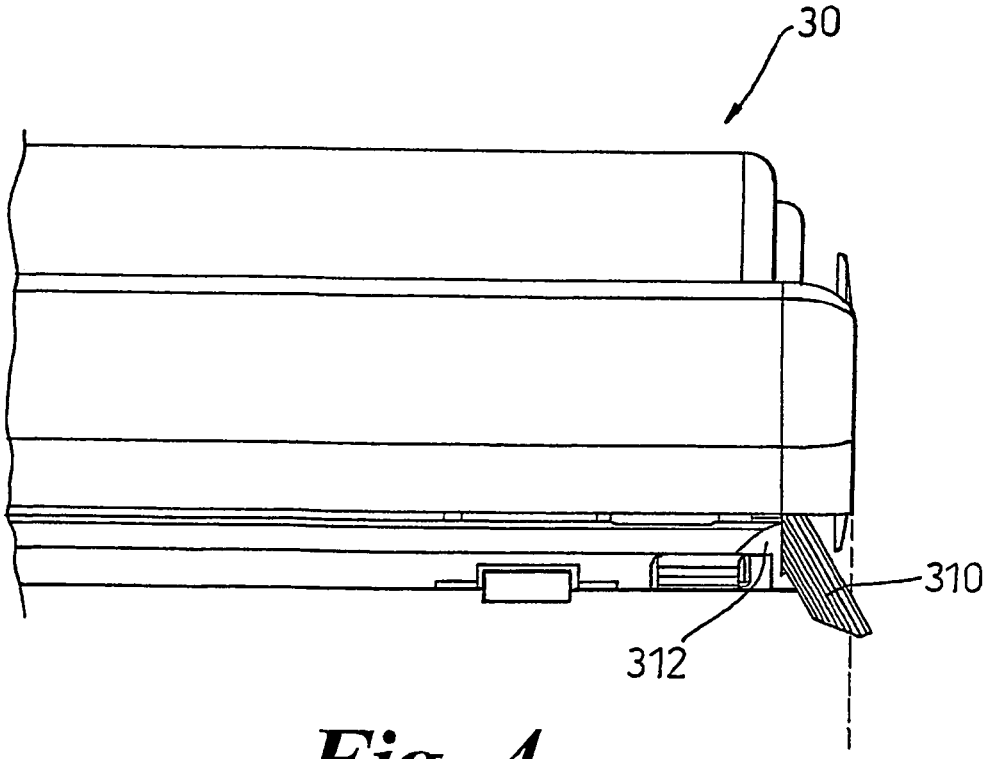
Figure 5:
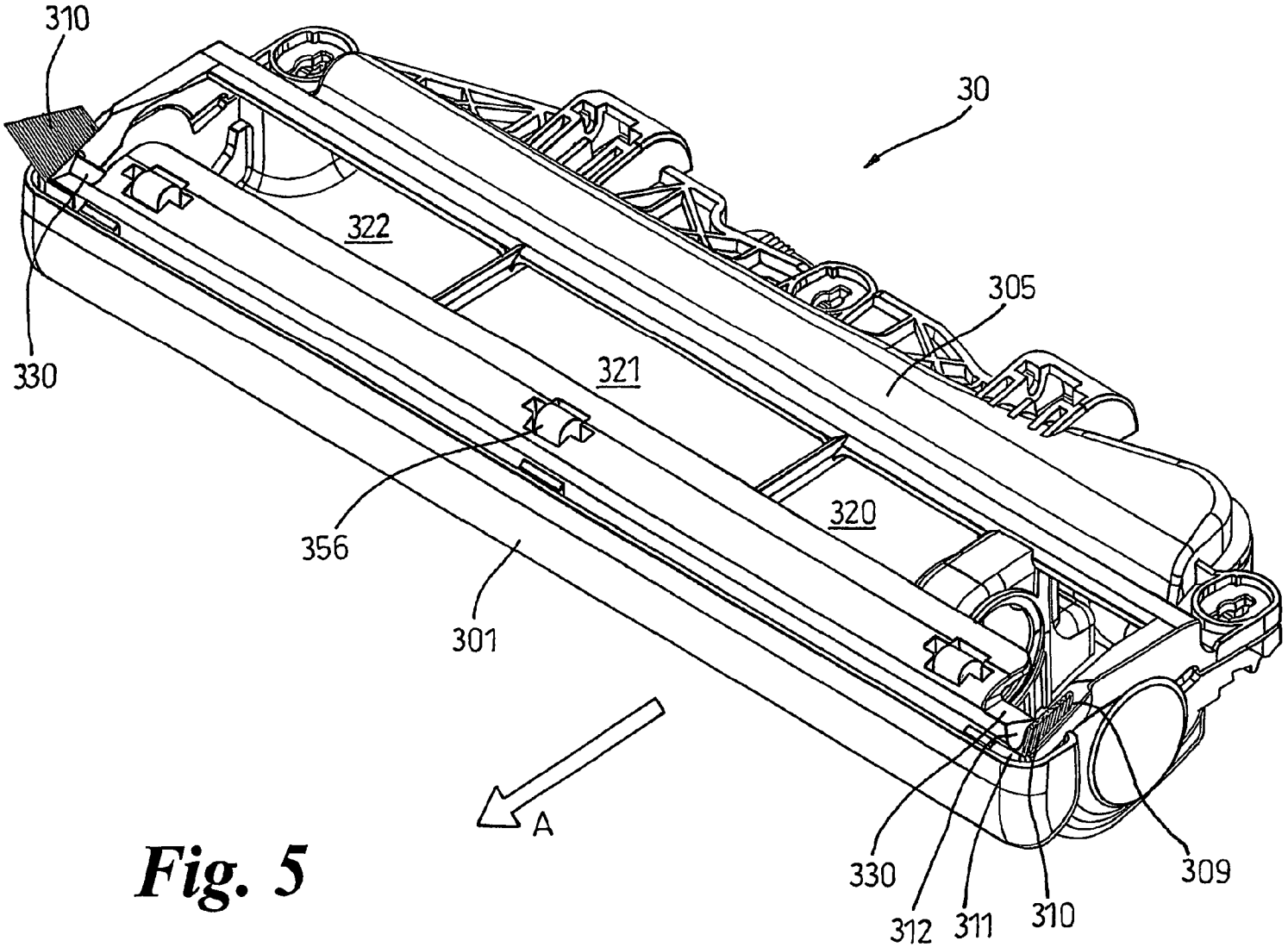

FIGS. 2-5 show a cleaning head 30 for use with the vacuum cleaner of FIG. 1. As seen in FIG. 2, cleaning head 30 comprises a housing 305 with an outlet 32 for connecting to the chassis of the vacuum cleaner. A flexible tube (not shown) connects the outlet 32 to a conduit on the chassis which leads to the separator unit 20. The cleaning head housing 305 comprises a front portion 301 which extends laterally across the width of the vacuum cleaner 100, transversely to the direction of movement of the cleaner and two rearwardly extending sides 302, 303. A lug 340 extends outwardly from each side 302, 303. Support arms (315, FIG. 1) support the cleaning head via these lugs 340 and allow the cleaning head 30 to pivot about the lugs.

The cleaning head 30 has an upper plate 351 and a lower plate 352 which may be made from plastics material or a metal such as stainless steel. The upper and lower plates 351, 352 are joined together by quarter turn fasteners (not shown), by press-fitting or by other suitable means. A seal 353 is trapped between the upper and lower plates 351, 352 so as to ensure that the seal between the plates 351, 352 is essentially airtight. Rollers 356 are rotatably mounted at the front edge of the lower plate 352 to support the cleaning head on the carpet or other surface to be cleaned. The rollers 356 can be positioned at or adjacent the outer edges of the lower surface or, alternatively, can either extend continuously or in a spaced manner across the entire width of the lower plate 352.

A suction opening 320, 321, 322 is formed in the lower plate 352. The suction opening extends across the entire width of the brush housing 305. A brush bar (not shown) is rotatably mounted in the housing 305 so that the bristles of the brush bar protrude slightly out of the suction opening 320, 321, 322. The brush bar is arranged to be drivable by the motor of the vacuum cleaner 100 in a conventional manner, for example, by way of a drive belt which enters the head via channel 370 in the upper plate 351 of the head.

A row of bristles 310 are mounted on each side of the lower plate 352 of the cleaning head. The bristles 310 are held together by a u-shaped metal clip which is crimped around one end of each tuft of the bristles. Thus, the row of bristles are a single part. The bristles 310 are supported in a rearwardly extending channel 309 in the lower plate 352 of the cleaning head. The bristles 310 are held within the channel 309 by a lip 311 on the forward portion of the upper plate 351. The bristles can be easily removed and replaced by separating the upper and lower plates 351, 352 of the head. The bristles 310 can then be slid out of the open end of the channel 309.

The bristles 310 are supported such that they project in a direction which is both diagonally outwardly and forwardly from the bottom corner of the cleaning head. The length of the bristles is such that the distal end of the bristles project beyond the side of the cleaning head 30 (see FIG. 4) and below the lower surface of the cleaning head. The bristles are sufficiently firm that they will provide an effective 'flicking' action on dirt when used for edge of the room cleaning. The bristles are also sufficiently flexible that they will not unnecessarily wear the floor surface when they are used away from the edge of the room. A suction channel 330 lies directly beside the bristles 310. The suction channel 330 extends rearwardly from the leading edge of the cleaning head. The suction channel 330 has a chamfered edge 312 which serves to guide dirt and dust towards the suction channel 330. The suction channel 330 provides a flow of fast-moving air adjacent to the bristles to ensure that dislodged dirt and dust will be carried into the cleaning head 30.

Figure 6:
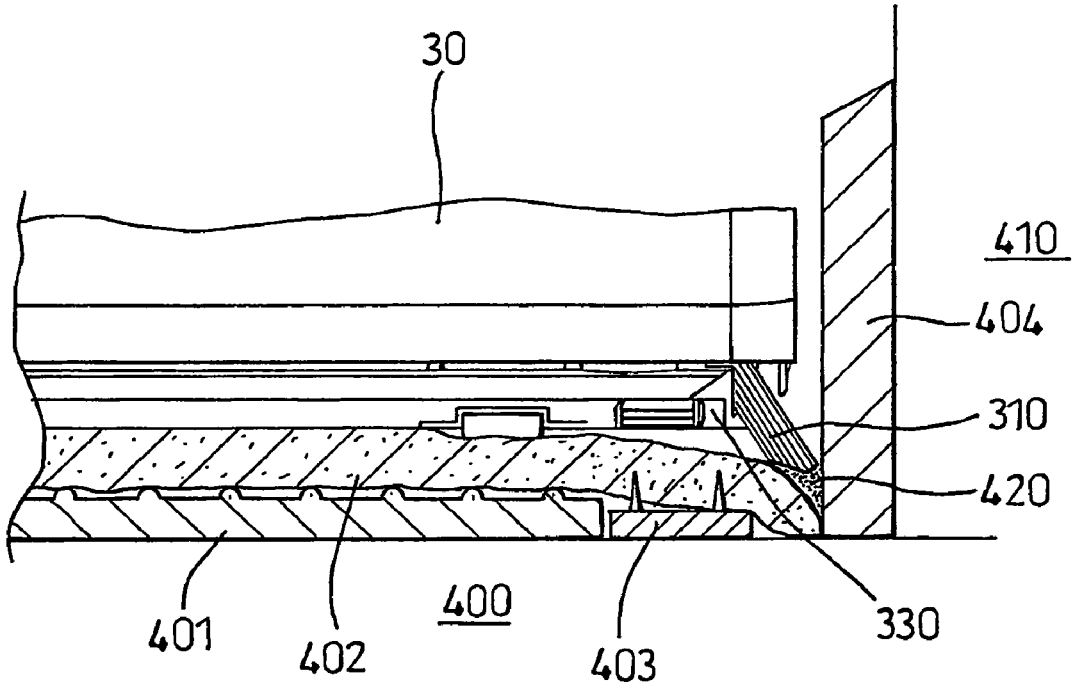

FIG. 6 shows the cleaning head 30 in use on a carpeted floor. FIG. 6 shows the region of the room directly adjacent a wall 410 of a room. The floor 400 is covered by an underlay material 401. A gripper board 403 lies between the edge of the underlay 401 and the skirting board 404. Carpet 402 overlies the underlay 401 and gripper board 403 and projects downwardly towards the floor 400 in the region next to the skirting board 404. It can be seen that dirt and dust readily accumulates in region 420 which lies below the level of the remainder of the carpet.

Bristles 310 on the side of the cleaning head 30 project into region 420. Because the bristles are directed forwardly, dirt, dust and other debris is prised out of region 420 and will either 'ride' up the leading edge of the row of bristles or will be flicked into the room (in a direction away from the wall 410). Thus, dirt is either guided towards the suction channel 330 or is moved to a different position where there is a much greater likelihood of it being successfully picked up. A good flow of air should be drawn into the cleaning head housing via suction channels 330. The dirt and dust which has been prised out of the edge region and towards suction channel 330 will be carried into the cleaning head housing as part of this airflow or via the other suction inlets 320, 321, 322.

The invention claimed is:

1. A cleaning head for a vacuum cleaner, comprising:

a housing with two opposite sides, such that the housing extends transversely relative to a direction of intended movement of the head while in use between the opposite sides, and a continuous row of bristles mounted on at least one of the two opposite sides, extending transversely outwardly and forwardly relative to the direction of intended movement of the cleaning head while in use from at least one of the opposite sides of the housing and extending to a level beneath the lowermost surface of the housing, wherein the housing has a suction channel formed therein that extends from an outer edge of the housing to a suction space within the housing and has an inlet on a leading edge of the housing that lies adjacent to and inwardly of the row of bristles, the suction channel being located adjacent to and extending parallel to the row of bristles.

2. The cleaning head according to claim 1, wherein the row of bristles is aligned with the side of the cleaning head.

3. The cleaning head according to claim 1, wherein the row of bristles is removably held in the housing.

4. The cleaning head according to claim 3, wherein the row of bristles is slideably received in a channel in the housing.

5. The cleaning head according to claim 1, further comprising at least two further rows of bristles, at least one of the further rows being positioned at each of the respective opposite sides of the housing.

6. A vacuum cleaner, comprising:

a body having an external surface, a suction inlet on the body for conveying dirty air from outside the vacuum cleaner into the body, a motor configured to draw the dirty air into the body through the suction inlet, a cleaning head including a housing with two opposite sides, such that the housing extends transversely relative to a direction of intended movement of the head between the opposite sides, and a continuous row of bristles mounted on at least one of the two opposite sides, extending transversely outwardly and forwardly relative to the direction of intended movement of the cleaning head while in use from at least one of the opposite sides of the housing and extending to a level beneath the lowermost surface of the housing, wherein the housing has a suction channel formed therein that extends from an outer edge of the housing to a suction space within the housing and has a further inlet on a leading edge of the housing that lies adjacent to and inwardly of the row of bristles, the suction channel extending parallel to the row of bristles.

7. The vacuum cleaner according to claim 6, wherein the row of bristles is aligned with the side of the cleaning head.

8. The vacuum cleaner according to claim 6, wherein the row of bristles is removably held in the housing.

9. The vacuum cleaner according to claim 8, wherein the row of bristles is slideably received in a channel of the housing.

10. The vacuum cleaner according to claim 6, further comprising at least two further rows of bristles, at least one of the further rows of bristles being positioned at each of the respective opposite sides of the housing.

* * * * *